US006003911A

United States Patent [19]

Sowash

[11] Patent Number: 6,003,911

[45] Date of Patent: Dec. 21, 1999

[54] DOOR STOP

[76] Inventor: Michael Robert C. Sowash, 349 Oak St., #6, Chico, Calif. 95926

[21] Appl. No.: 08/656,086

[22] Filed: May 31, 1996

[51] Int. Cl.[6] ..... E05C 17/54; E05C 19/18

[52] U.S. Cl. ..... 292/343; 292/288; 16/82

[58] Field of Search ..... 16/82, 86 R; 292/288, 292/339, DIG. 19, 342, 343, DIG. 15; 72/385, 479, 386, 458; 144/568

[56] References Cited

U.S. PATENT DOCUMENTS

| | | | |
|---|---|---|---|
| D. 303,756 | 10/1989 | Meyers | D8/402 |
| 741,671 | 10/1903 | Jenkins | 72/386 |
| 2,196,726 | 4/1940 | Folsom | 292/288 |
| 2,565,906 | 8/1951 | Berthene | 292/288 |
| 2,898,140 | 8/1959 | Gislason | 16/82 |
| 3,143,369 | 8/1964 | Adams . | |
| 3,610,019 | 10/1971 | Denninger | 72/386 |
| 3,620,483 | 11/1971 | Weinberger | 292/288 |
| 3,758,141 | 9/1973 | Weinberger | 16/82 |
| 3,786,533 | 1/1974 | O'Donnell | 16/82 |
| 4,831,688 | 5/1989 | Deininger | 16/82 |
| 5,027,471 | 7/1991 | Barnes | 16/82 |
| 5,044,681 | 9/1991 | Neighbors | 292/288 |
| 5,123,685 | 6/1992 | Donovan | 16/82 |
| 5,288,257 | 2/1994 | Zacherl | 292/DIG. 19 |
| 5,369,840 | 12/1994 | Salvador et al. | 16/82 |
| 5,586,793 | 12/1996 | Davenport | 292/288 |

FOREIGN PATENT DOCUMENTS

| | | | |
|---|---|---|---|
| 260450 | 5/1913 | Germany | 16/82 |
| 383650 | 10/1923 | Germany | 292/288 |
| 3514244 | 10/1986 | Germany | 292/288 |

*Primary Examiner*—Chuck Y. Mah
*Assistant Examiner*—Donald M. Gurley
*Attorney, Agent, or Firm*—Leo F. Costello

[57] ABSTRACT

The door stop comprises a stop block. One of the surfaces of the stop block has an angular recess therein with angular faces positioned at an acute angle with respect to the stop block surfaces. The stop block is configured to insert into the jamb when the door is opened and the angular faces engaged over the top corner of the hinge edge stile of the door to hold the door open. A handle is attached to the stop block so that it may be easily inserted and removed.

25 Claims, 2 Drawing Sheets

DOOR STOP

TECHNICAL FIELD

This invention is directed to a door stop which can be readily engaged between the door frame and hinge edge of the door to hold the door open.

BACKGROUND ART

Doors are hinged to door frames to selectively close the opening through the door frame. Sometimes, it is desirable to keep the door open, particularly when regular passage therethrough is needed and when ventilation is desired. Another case is when the privacy achieved by the closing of the door is not desired. Maintaining the door in the open position is sometimes difficult because of wind or the presence of a door closer. In such a case, a door stop is needed.

There are many different designs of door stops. The simplest are wedges of various shapes and of various materials for fitting under the door when it is open. These wedge-type door stops engage on the floor beneath the open door. Such door stops can be mislaid. As a consequence, there is a class of door stops which re basically rubber-tip legs which are hinged on the inside of the door. When these are swung down, they angularly engage upon the floor to hold the door open to the selected position. In any event, door stops of this nature require that the user bend down to the floor to install or remove the door stop, or in the case of a hinged leg, to swing the leg down and into the active position and back up into the inactive position. Accordingly, there is need for a door stop which can be easily installed and removed without bending.

SUMMARY OF INVENTION

In order to aid in the understanding of this invention, it can be stated in essentially summary form that it is directed to a door stop which comprises a stop block having a back surface and, opposite the back surface, there are two faces which define an angular recess. The stop block is configured to be of such size that the recess engages over the upper corner of the hinge edge stile of the door and the back block surface engages in the door frame to hold the door in position. The stop block may have a handle to aid in its installation and removal.

It is, thus, a purpose and advantage of this invention to provide a door stop which can be inserted between the door hinge edge stile and the door frame to selectively hold the door open.

It is a further purpose and advantage of this invention to provide a door stop which is configured to engage between the door and the door frame at such a height as to obviate the need for bending over when placing and removing the door stop.

It is a further purpose and advantage of this invention to provide a door stop which is economic to manufacture so that it can be widely used.

Other features of the present invention are disclosed or apparent in the section entitled "BEST MODE FOR CARRYING OUT THE INVENTION."

BRIEF DESCRIPTION OF THE DRAWINGS

For a fuller understanding of the present invention, reference is made to the accompanying drawings taken in conjunction with the following detailed description of the Best Mode For Carrying Out The Invention. In the drawing.

Figure 1:
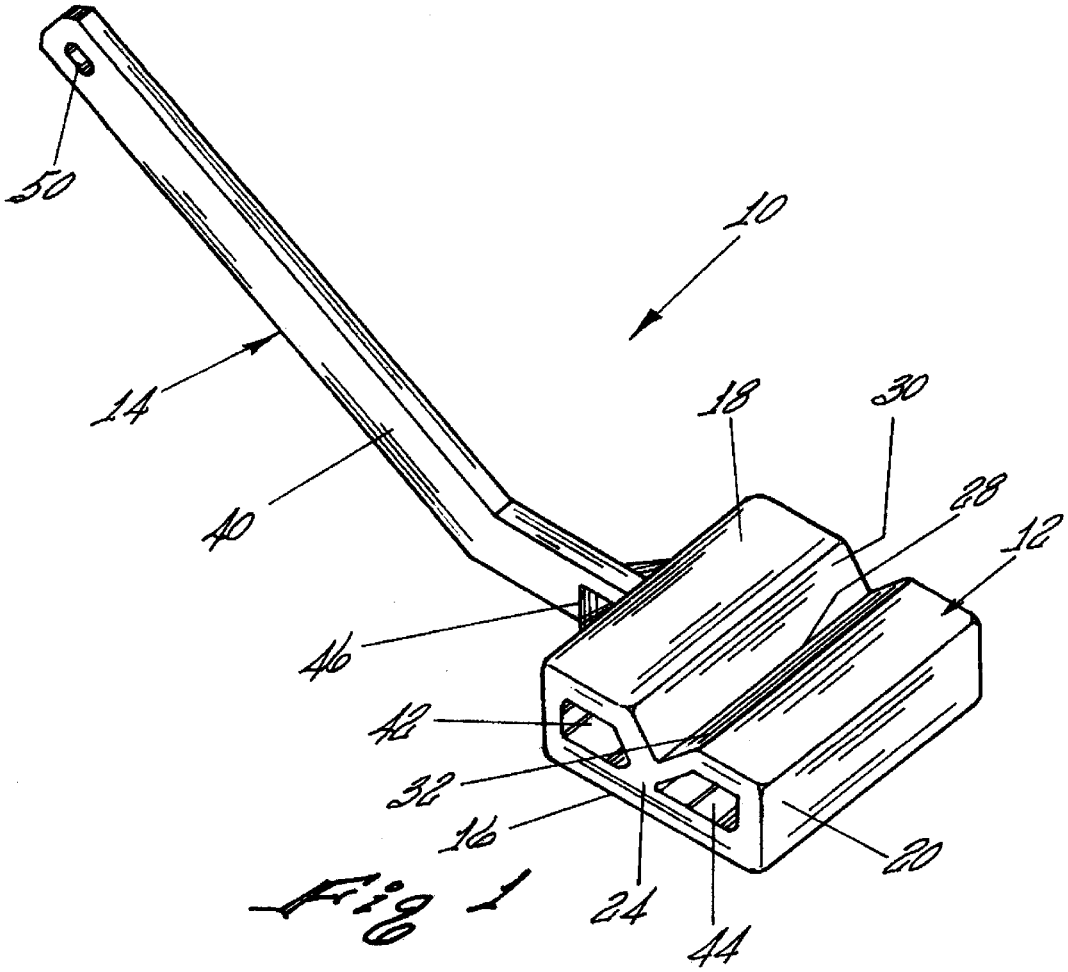
FIG. 1 is a isometric view of the door stop of this invention.

Reference numbers refer to the same or equivalent parts of the present invention throughout the several figures of the drawing.

BEST MODE FOR CARRYING OUT THE INVENTION

Figure 2:
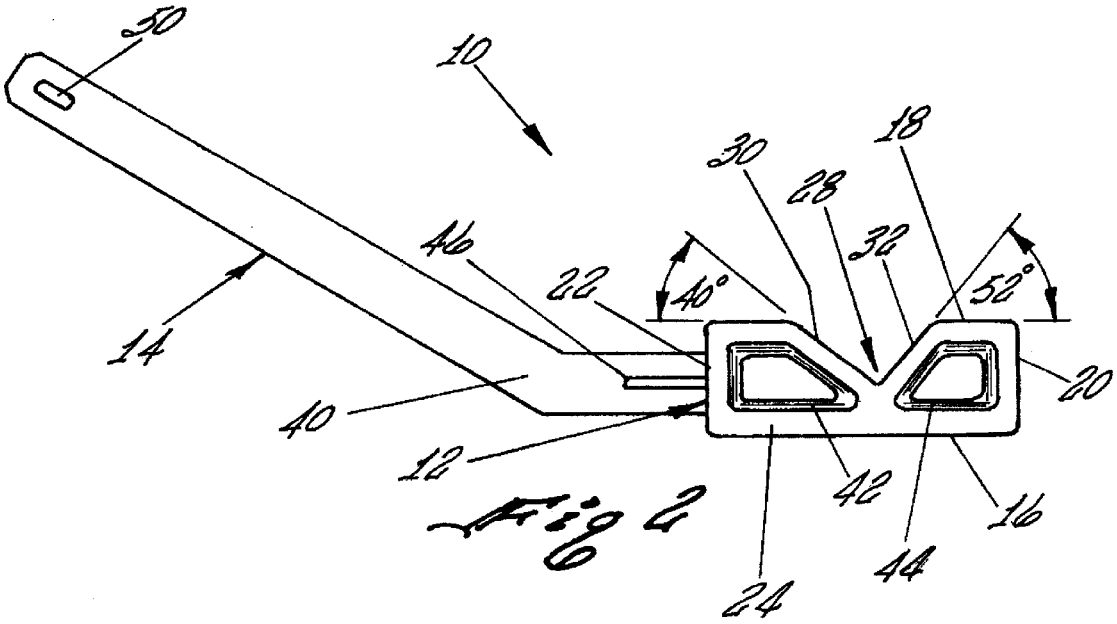
FIG. 2 is a side-elevational view thereof.
Figure 4:
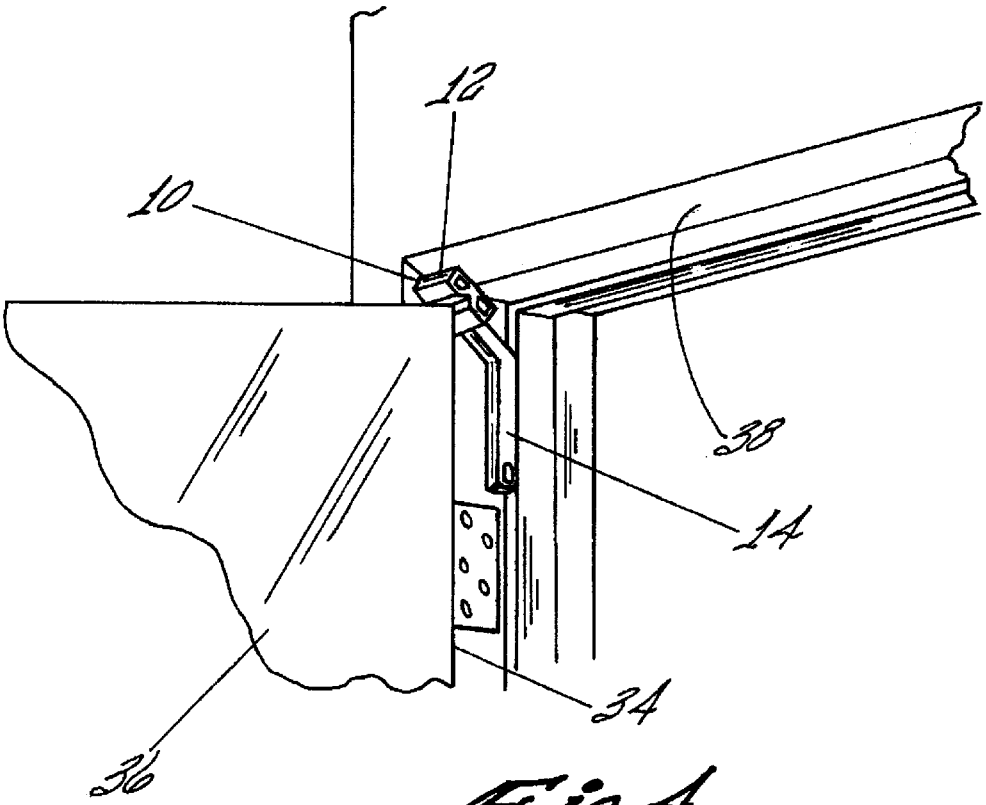
FIG. 4 is a perspective view of the door stop in use.
Figure 3:
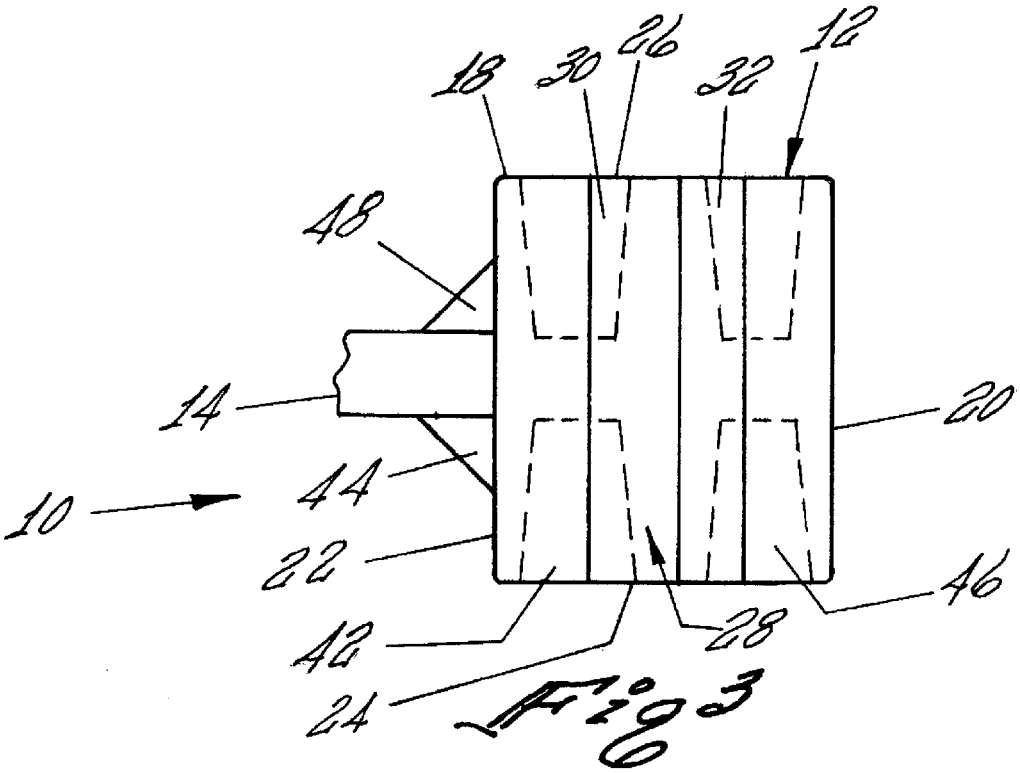
FIG. 3 is a plan view of the recess side thereof, with the handle partly broken away.

The door stop of this invention is generally indicated at 10 in FIGS. 1, 2 and 3 and is seen holding open a door in FIG. 4. The door stop 10 comprises a stop block 12 and a handle 14. The stop block 12 has a top surface 16 and a bottom surface 18. These designations apply with the understanding that the user is holding the handle 14 in his hand with the stop block 12 away from him and the surface 18 facing more downward than upward. In this position, the stop block has a far surface 20, a near surface 22, as well as left and right surfaces 24 and 26.

Recess 28 is formed in the bottom surface by angular faces 30 and 32. As seen in FIG. 2, these angular faces are planar and are almost at a right angle with respect to each other. These faces extend across bottom surface 18 between left and right surfaces 24 and 26. As seen in FIG. 2, face 30 is at 40 degrees with respect to the bottom surface 18, while face 32 is at 52 degrees with respect thereto. Thus, the angular faces 30 and 32 are at almost a right angle with respect to each other with the bisector therebetween angled toward the handle end. In fact, the angle between these surfaces is 88 degrees.

The distance between the bottom of the recess 28, defined as the intersection between the planes of the two faces 30 and 32 and the top surface 16 is such that the door stop fits between the top of the hinge edge stile surface 34 of door 36, see FIG. 4, and door frame 38. It is seen that the recess 28 fits over the top hinge corner of the door, and the back of the block engages against the door frame. Handle 14 has a bend 40 therein so that, when the stop block is in position, the handle extends down adjacent to the stop molding in the door frame, as seen in FIG. 1. This places the handle in a position where the stop block can be easily inserted and removed from its door stop position shown in FIG. 4.

The door stop 10 may be injection-molded in one piece or two pieces. In order to reduce the mass of the stop block 12, it can be provided with tapered molding recesses, shown in dashed lines in FIG. 3. Molding recesses 42 and 44 are shown in FIGS. 1, 2 and 3, and are tapered to facilitate easy demolding of the stop block during manufacture of the door stop 10.

The handle may be molded with the stop block or as a separate part and attached by any convenient means. Flanges 46 and 48 are shown in FIG. 3 as being integral with or attached to both the handle and the stop block to strengthen the juncture therebetween. In this way, the door stop can be manufactured to be sufficiently strong for the purpose and to have a long life, while at the same time, providing economic manufacture.

The handle 14 is provided with a hole 50 through the end thereof through which a strap may be looped. This permits the door stop 10 to be hung conveniently on a pin provided next to the door 36 when the door stop 10 is not in use.

The stop block 12 in the illustrated embodiment of the invention has a height of 1.09", a width in the direction of the recess 28 of 2.5" and a length in the direction of the handle 14 of 2.11". The recess 28 has a depth of 0.5", and the edges of the recess are located at 0.57" and 0.6" respectively from surfaces 20 and 22.

The length of the handle 14 between the stop block 12 and the bend 40 is 1.6", and the remaining length of the handle 14 from the bend 40 is 5.0". The handle 14 has a 0.5" by 0.5" square cross section.

Molding recesses 42 and 44 have an overall taper of 10°.

In alternative embodiments of the invention, the thickness of the stop block 12 may be varied to accommodate different door and frame configurations. It is believed that the stop block 12 will be manufactured in thicknesses ranging from approximately 0.75" to 1.1". This will preferably be done by removing material from the top surface 16 of the stop block 12. This can easily be accomplished by the use of inserts in a mold used to manufacture the preferred embodiment of the invention.

Further modifications include varying the length of the handle 14 from a short stub which ends approximately at the bend 40 in the illustrated embodiment, to a handle which has a total length of two feet. A door stop 10 with a short handle 14, or no handle at all, can be carried conveniently in the pocket of a bell-hop, while a door stop 10 with a long handle may conveniently be used in industry on doors having large frames, or by a person having a physical disability.

Additionally, while the illustrated door stop 10 is made of a synthetic polymer composition, it will be appreciated that it may be made of alternative materials. In particular, a streamlined handcrafted hardwood embodiment without molding recesses 42, 44 will provide an attractive version for home use. In such an embodiment, a brass hook may be provided in the end of the handle 14 for use when hanging the door stop 10 next to the door.

This invention has been described in its most preferred embodiment, and it is clear that it is susceptible to numerous modifications, modes and embodiments within the ability of those skilled in the art and without the exercise of the inventive faculty.

What is claimed is:

1. A door stop for maintaining a door in open position, the door having a side edge hinged to a door frame and an inside corner meeting the side edge, the door having an open position where there is a lateral gap defining a predetermined distance between said corner and the door frame, the door stop comprising:

a stop block, said stop block having first and second opposite surfaces, said first surface having an elongated recess therein, said recess having a shape substantially complementary to said corner of the door and having a bottom spaced from the second surface by a thickness dimension substantially equal to or less than said predetermined distance, whereby the stop can be inserted between corner of the door and the door frame with said corner fitting in said recess in the first surface and with the second surface engaging the door frame thereby to inhibit the door from closing.

2. The door stop of claim 1 wherein said recess is formed of first and second faces angularly arranged with respect to each other.

3. The door stop of claim 2 wherein said angular faces are substantially planar surfaces.

4. The door stop of claim 3 wherein said second surface is substantially planar and one of said angular recess faces lies substantially at an angle of 40 degrees with respect to said second surface.

5. The door stop of claim 2 wherein said first and second recess faces lie at approximately 90 degrees with respect to each other.

6. The door stop of claim 1 wherein the intersection of the faces of said recess define a substantially straight line.

7. The door stop of claim 2 wherein said line is substantially parallel to said second surface.

8. The door stop of claim 1 wherein said first surface has substantially planar portions extending outwardly from the recess .

9. The door stop of claim 1 wherein said second surface is substantially planar, wherein said bottom is defined by the intersection of said faces along a substantially straight line, said line lying substantially parallel to said second surface and spaced therefrom by said thickness dimension.

10. The door stop of claim 1 wherein there is a handle attached to said stop block.

11. The door stop of claim 10 wherein said handle has inner and outer portions joined by a bend therein, the outer portion being substantially parallel to one of the faces of the recess.

12. A method of using a door stop to prevent a a door from closing in its door frame, the door having an inside corner adjacent to the frame, the door stop having an elongated recess that fits the inside corner of the door, comprising:

opening the door until there is an elongated space between said inside corner and the door frame outwardly of the frame; and fitting the recess of the door stop over said inside corner with the door stop in said space and with the stop bearing against said corner and the door frame thereby to inhibit closing of the door.

13. A door stop for holding a door in open position, the door having a vertical inside side edge hinged to a door frame, a horizontal top edge and an inside top corner joining the top and side edges, the door having an open position where there is a lateral extending gap between said corner and the door frame the door stop comprising:

a stop block of generally rectangular shape, said stop block having opposite front and back surfaces spaced from each other, said front surface having an elongated recess therein defined by substantially planar faces intersecting at an angle to define a line at the bottom of the recess, said line being spaced from said back surface by a distance substantially equal to or slightly less than said gap, so that when the block is inserted between said corner of the door and the door frame with the recess receiving the said corner and the back surface bearing against the door frame, the block holds the door in open position.

14. The door stop of claim 13 wherein said back surface is substantially planar.

15. The door stop of claim 14 wherein said stop block is formed of synthetic polymer composition material and has at least two molding recesses therein, said molding recesses being substantially parallel to said recess defined by said angular faces.

16. The door stop of claim 13 further including a handle attached to said stop block, said handle protecting away from the block transversely of the line in the recess.

17. The door stop of claim 16 wherein the handle has a portion that is substantially parallel to the back surface.

18. The door stop of claim 16 wherein the face of the recess which lies closest to said handle lies at approximately 40 degrees with respect to said back surface.

19. The door stop of claim 16 wherein the handle has a portion that is substantially parallel to one of the faces of the recess.

20. The door stop of claim 13 wherein one of said faces defining said recess is substantially planar and lies substantially at 40 degrees with respect to said second surface.

21. The door stop of claim 13 wherein the front surface has planar portions that extend outwardly from the recess in substantially parallel relation to the back surface.

22. The door stop of claim 21 wherein the block has opposite end surfaces substantially parallel to each other, the recess extending between and opening from said opposite end surfaces.

23. The door stop of claim 22 wherein a handle projects from one of said end surfaces in substantially parallel relation to the back surface.

24. The door stop of claim 22 wherein a handle has an inner portion projecting from one of said end surfaces in substantially parallel relation to the back surface and an outer portion projecting from the inner portion in substantially parallel relation to the adjacent face of the recess.

25. In combination, a door frame;

a door having an inside edge hinged to the frame and an inside corner joining the inside edge, the door being movable into an open position wherein the inside corner is outside of and laterally spaced from the door frame; and an elongated stop block having front and back surfaces, the front surface including a recess shaped to fit the corner of the door, the block being removably interposed the door and the door frame when the door is in said open position, with the corner of the door received in the recess, with the front surface bearing against the inside edge of the door, and with the back surface bearing against the door frame, thereby holding the door in open position.

* * * * *